US011570543B2

(12) United States Patent
Yu

(10) Patent No.: US 11,570,543 B2
(45) Date of Patent: Jan. 31, 2023

(54) LOUDSPEAKER POLAR PATTERN CREATION PROCEDURE

(71) Applicant: Biamp Systems, LLC, Beaverton, OR (US)

(72) Inventor: Xian Yu, Bryn Mawr, PA (US)

(73) Assignee: Biamp Systems, LLC, Beaverton, OR (US)

( * ) Notice: Subject to any disclaimer, the term of this patent is extended or adjusted under 35 U.S.C. 154(b) by 0 days.

(21) Appl. No.: 17/390,589

(22) Filed: Jul. 30, 2021

(65) Prior Publication Data

US 2022/0232311 A1 Jul. 21, 2022

Related U.S. Application Data

(60) Provisional application No. 63/139,803, filed on Jan. 21, 2021.

(51) Int. Cl.

| | |
|---|---|
| ***H04R 3/00*** | (2006.01) |
| ***H04R 1/20*** | (2006.01) |
| ***H04R 1/28*** | (2006.01) |
| ***H04R 1/32*** | (2006.01) |
| ***H04R 5/04*** | (2006.01) |

(52) U.S. Cl.
CPC ..... *H04R 1/2803* (2013.01); *H04R 1/323* (2013.01); *H04R 5/04* (2013.01)

(58) Field of Classification Search
CPC ... H04R 3/00; H04R 3/04; H04R 3/12; H04R 1/025; H04R 1/20; H04R 1/26; H04R 1/28; H04R 1/32; H04R 1/323; H04R 1/2803; H04R 1/40; H04R 1/403; H04R 5/00; H04R 5/04; H04S 7/00; G10K 11/04; G10K 11/008
See application file for complete search history.

(56) References Cited

U.S. PATENT DOCUMENTS

| | | | | |
|---|---|---|---|---|
| 6,513,622 | B1 * | 2/2003 | Gelow | H04R 1/345 381/345 |
| 6,674,864 | B1 * | 1/2004 | Kitamura | H04R 3/14 381/103 |
| 2011/0301731 | A1 * | 12/2011 | Okimoto | H04R 3/00 700/94 |
| 2012/0121092 | A1 | 5/2012 | Starobin | |
| 2012/0224701 | A1 * | 9/2012 | Sakai | H04S 7/301 381/17 |
| 2013/0089215 | A1 * | 4/2013 | Kon | H04R 3/04 381/74 |
| 2015/0365775 | A1 | 12/2015 | Davis et al. | |

(Continued)

FOREIGN PATENT DOCUMENTS

| | | | | |
|---|---|---|---|---|
| JP | 2007026222 A | * | 2/2007 | H04S 7/301 |
| JP | 2008219228 A | * | 9/2008 | H04R 3/00 |

OTHER PUBLICATIONS

International Search Report issued in the International Application No. PCT/US22/13025, dated Apr. 27, 2022.

*Primary Examiner* — Thang V Tran

(57) ABSTRACT

An example method of operation includes performing a plurality of polar pattern permutations based on a function of an inputted magnitude and phase adjustment range, determining a plurality of polar pattern outputs, creating a list of the polar pattern outputs, and creating a set of FIR filters to apply to a loudspeaker based on a selected one of the list of polar patterns.

20 Claims, 17 Drawing Sheets

(56) References Cited

U.S. PATENT DOCUMENTS

| | | | | |
|---|---|---|---|---|
| 2016/0021458 | A1 | 1/2016 | Johnson et al. | |
| 2018/0184199 | A1* | 6/2018 | Fontana | H04R 1/403 |
| 2018/0352325 | A1* | 12/2018 | Family | H04R 1/403 |
| 2019/0200132 | A1* | 6/2019 | Horbach | H04R 1/403 |
| 2021/0006892 | A1 | 1/2021 | Tsutsumi et al. | |
| 2021/0067875 | A1* | 3/2021 | Horbach | H04R 1/403 |

* cited by examiner

300

350

800

900

1000

1100

| # | Cvrg Angle | Max Lobe [Out] | All Lobe [Out] | Max Lobe [In] | E% | Attn. |
|---|---|---|---|---|---|---|
| 1 | 20 | 58 | 216 | 0 | 47 | 9 |
| 2 | 20 | 64 | 128 | 0 | 43 | 9 |
| 3 | 20 | 68 | 250 | 0 | 45 | 9 |
| 4 | 20 | 84 | 288 | 0 | 44 | 6 |
| 5 | 20 | 102 | 344 | 0 | 41 | 6 |
| 6 | 20 | 112 | 362 | 0 | 40 | 3 |
| 7 | 20 | 127 | 416 | 0 | 37 | 3 |
| 8 | 20 | 150 | 486 | 0 | 33 | 0 |

1112

1114

FIG. 11A

LOUDSPEAKER POLAR PATTERN CREATION PROCEDURE

CROSS-REFERENCE TO RELATED APPLICATION

This application claims priority to earlier filed U.S. provisional patent application No. 63/139,803 entitled, "LOUDSPEAKER POLAR PATTERN CREATION," filed on Jan. 21, 2021, the entire contents of which are hereby incorporated by reference.

BACKGROUND

Speakers and their installation on ceilings and walls and other places raises a degree of concern with how quickly they can be setup and secured. Also, the acoustic fingerprint in a particular environment will vary depending on the environment size and anatomy. Utilizing feedback and sounds to calibrate an environment can be helpful in tuning a number of speakers, speaker types, speaker angles, positions, output amplitude, angles, etc. However, feedback and calibration are not always easy to perform especially by someone without the proper training. Performing a pre-installation analysis of the environment anatomy by a modeling algorithm to identify fundamental design considerations may optimize the audio setup process.

SUMMARY

One example embodiment may provide identifying, in a memory, a loudspeaker profile of a loudspeaker, wherein the loudspeaker profile comprises a plurality of drivers, a specified size of the drivers, models of the drivers, positions of the drivers, and orientations of the drivers within a loudspeaker cabinet of the loudspeaker, defining a number of permutations of filter settings to be performed during a simulation, wherein each filter setting comprises one or more of a magnitude and phase adjustment for each of multiple frequency bands to apply to each driver within the loudspeaker, iterating through the filter setting permutations with each filter setting applied to the drivers and calculating loudspeaker polar patterns, storing the calculated polar patterns in a database, selecting a polar pattern from the database that is the closest match to a target polar pattern, and applying a filter setting that corresponds to the selected polar pattern to generate a FIR to apply to each driver within the loudspeaker.

Another example embodiment may include a processor configured to identify, in a memory, a loudspeaker profile of a loudspeaker, wherein the loudspeaker profile comprises a plurality of drivers, a specified size of the drivers, models of the drivers, positions of the drivers, and orientations of the drivers within a loudspeaker cabinet of the loudspeaker, define a number of permutations of filter settings to be performed during a simulation, wherein each filter setting comprises one or more of a magnitude and phase adjustment for each of multiple frequency bands to apply to each driver within the loudspeaker, iterate through the filter setting permutations with each filter setting applied to the drivers and calculating loudspeaker polar patterns, store the calculated polar patterns in a database, select a polar pattern from the database that is the closest match to a target polar pattern, and apply a filter setting that corresponds to the selected polar pattern to generate a FIR to apply to each driver within the loudspeaker.

Another example embodiment may include a non-transitory computer readable storage medium configured to store instructions that when executed cause a processor to perform identifying, in a memory, a loudspeaker profile of a loudspeaker, wherein the loudspeaker profile comprises a plurality of drivers, a specified size of the drivers, models of the drivers, positions of the drivers, and orientations of the drivers within a loudspeaker cabinet of the loudspeaker, defining a number of permutations of filter settings to be performed during a simulation, wherein each filter setting comprises one or more of a magnitude and phase adjustment for each of multiple frequency bands to apply to each driver within the loudspeaker, iterating through the filter setting permutations with each filter setting applied to the drivers and calculating loudspeaker polar patterns, storing the calculated polar patterns in a database, selecting a polar pattern from the database that is the closest match to a target polar pattern, and applying a filter setting that corresponds to the selected polar pattern to generate a FIR to apply to each driver within the loudspeaker.

BRIEF DESCRIPTION OF THE DRAWINGS

FIG. 11A illustrates a table of values used to identify the most optimal polar patterns according to example embodiments.

DETAILED DESCRIPTION

Figure 1A:
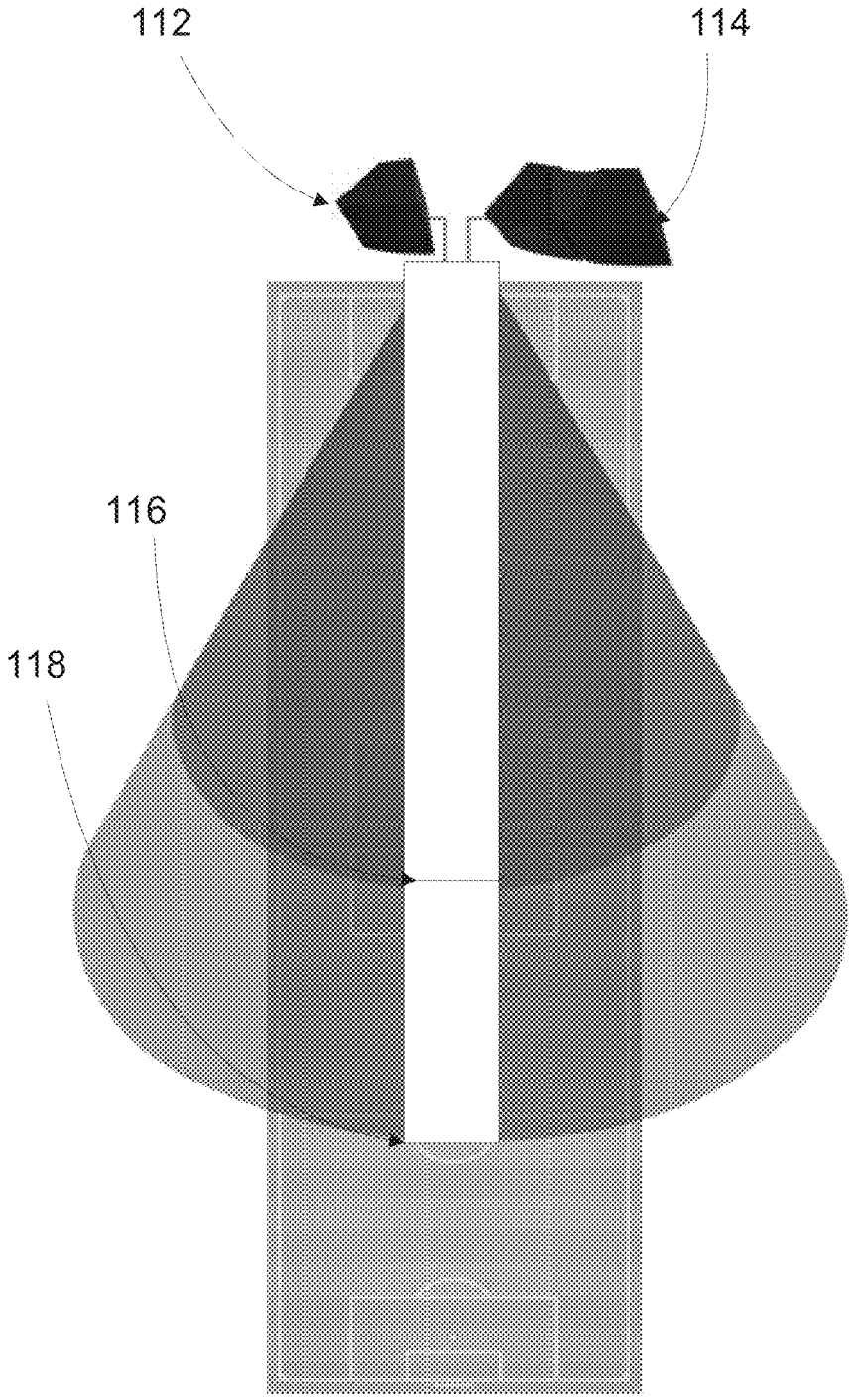
FIG. 1A illustrates a multi-loudspeaker configuration for a particular venue according to example embodiments.

It will be readily understood that the instant components, as generally described and illustrated in the figures herein, may be arranged and designed in a wide variety of different configurations. Thus, the following detailed description of the embodiments of at least one of a method, apparatus, non-transitory computer readable medium and system, as represented in the attached figures, is not intended to limit the scope of the application as claimed, but is merely representative of selected embodiments.

The instant features, structures, or characteristics as described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

In addition, while the term "message" may have been used in the description of embodiments, the application may be applied to many types of network data, such as, packet, frame, datagram, etc. The term "message" also includes packet, frame, datagram, and any equivalents thereof. Furthermore, while certain types of messages and signaling may be depicted in exemplary embodiments they are not limited to a certain type of message, and the application is not limited to a certain type of signaling.

Example embodiments provide a speaker configuration and simulation application that generates polar patterns and stores the values for iterative optimization and selection purposes based on certain inputs and design objectives. Also, certain graphical user interfaces provide a visual realization of the polar pattern of a multi-driver loudspeaker and/or loudspeaker array. By applying a finite impulse response (FIR) filter to each driver or group of drivers which drive the loudspeaker(s) polar patterns can be identified and narrowed into ideal or near ideal patterns which best achieve the design objectives.

The desired loudspeaker polar pattern generally depends on the geometry of a particular venue. For example, venues with flat floors such as transportations, cathedrals, mosques, etc. need a narrower polar pattern; venues with raked seating planes and balconies such as theaters, lecture halls, congresses, etc. need a wider loudspeaker polar pattern. A venue may also require different loudspeaker polar patterns depending on the use-cases. Referring to FIG. 1B, the loudspeaker system can be optimized for lower seating only 122 and not upper seating 120, or for both lower 132 and upper seating 130. The settings for different use-cases can be controlled electronically by applying unique FIR filters to each driver within the loudspeaker cabinet.

Figure 1B:
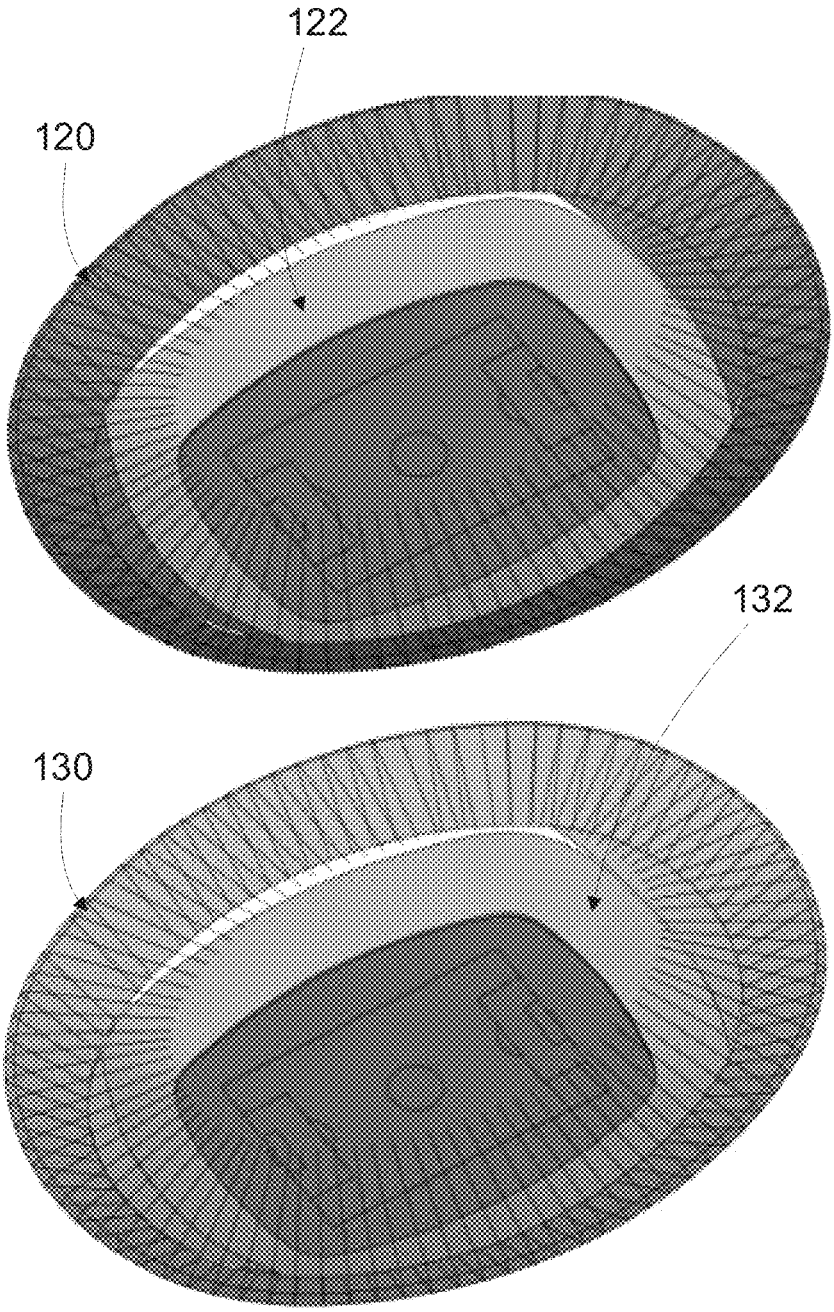
FIG. 1B illustrates varying loudspeaker optimization configurations for a particular venue according to example embodiments.

FIG. 1A illustrates a multi-loudspeaker configuration for a particular venue according to example embodiments. Referring to FIG. 1A, the example provides a single loudspeaker array (single cabinet) 112 combined with a dual loudspeaker array (dual cabinet) 114 as a potential loudspeaker implementation for a particular venue having a particular venue geometry. The rated values may be, for example, 96 dB at 158 meters for the dual cabinet as denoted by the second line 118, and 96 dB at 112 meters for the single cabinet as denoted by the first line 116. The modeling required to identify the venue objectives can provide loudspeaker driver configurations for applying select filters and generating a polar output pattern which is ideal for certain geometries and desired angles to be applied to the venue audio.

Figure 2A:
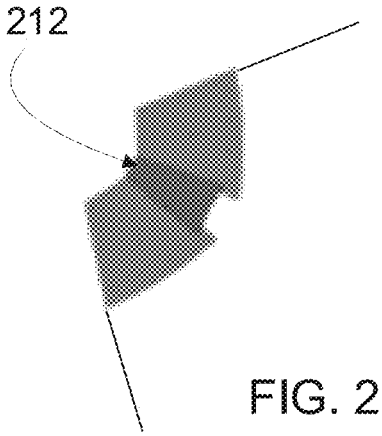
FIG. 2A illustrates a dual loudspeaker array configuration according to example embodiments.
Figure 2B:
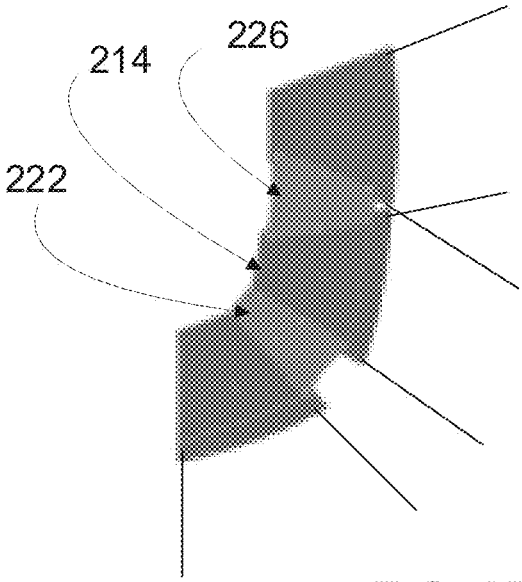
FIG. 2B illustrates a triple loudspeaker array configuration according to example embodiments.
Figure 2C:
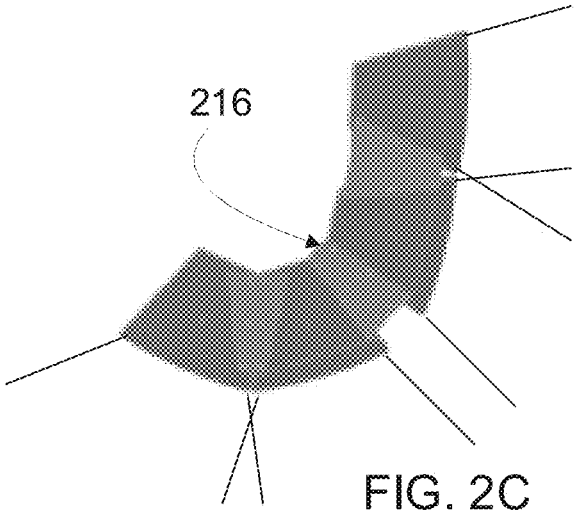
FIG. 2C illustrates a quadruple loudspeaker array configuration according to example embodiments.

FIG. 2A illustrates a dual loudspeaker array configuration according to example embodiments. Referring to FIG. 2A, the example two speaker array 212 is illustrated as having a particular splay plate which defines the angles between the loudspeakers and their relative position when mounted from a wall or the ceiling (i.e., splay angles). The splay angles in the array 214 of FIG. 2B includes a smaller splay angle 222 set by a smaller splay angle and a larger splay angle 226 defined by a larger splay plate. The total number of loudspeakers may include three in this example. In FIG. 2C, a quadruple loudspeaker array configuration 216 is illustrated with three different splay angles.

Figure 3A:
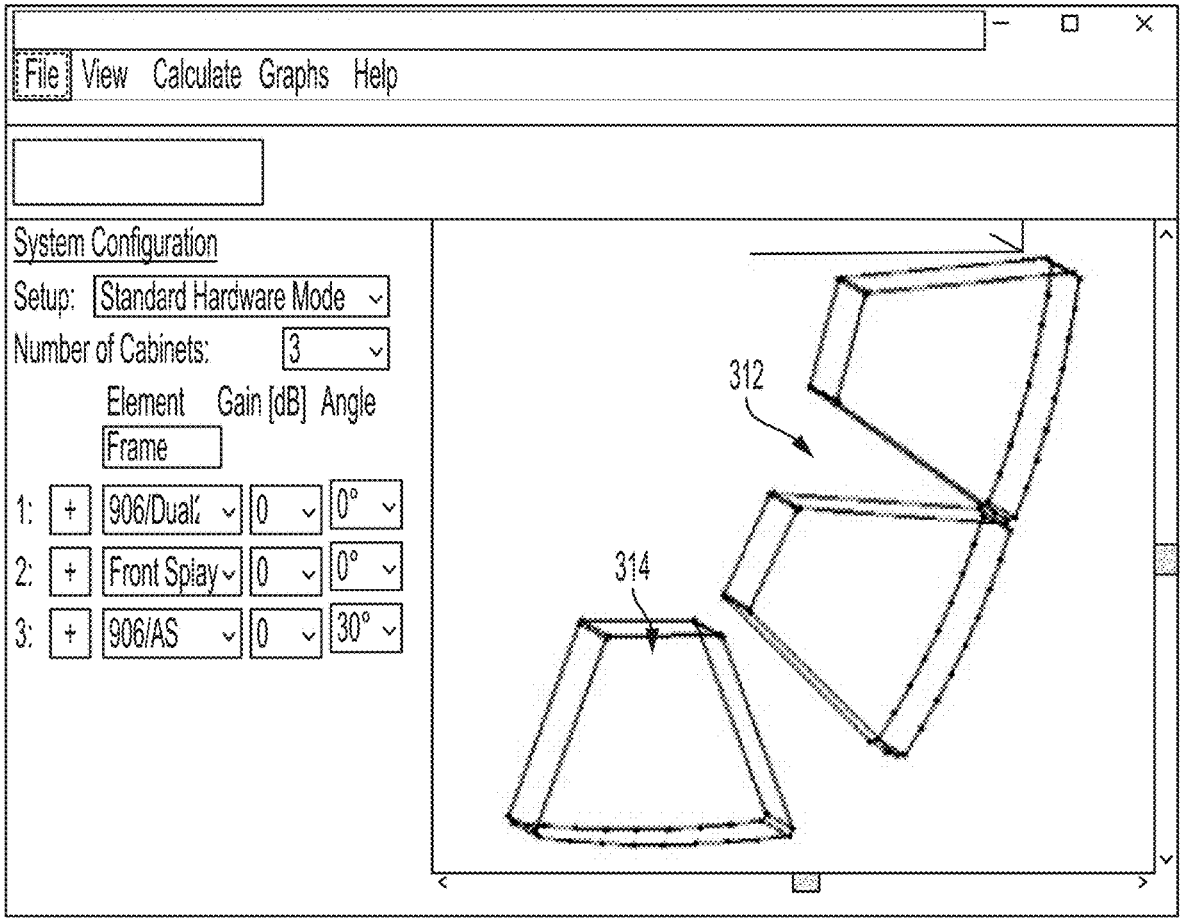
FIG. 3A illustrates an example graphical user interface of a loudspeaker array model according to example embodiments.

FIG. 3A illustrates an example loudspeaker array model according to example embodiments. Referring to FIG. 3A, the modeling application demonstrates cabinet size, position, splay angle, and other information, which may be setup in a simulation process for creating a polar pattern output signal. The coverage patterns sought may be achieved by selecting certain loudspeaker models from memory which log the output characteristics of the loudspeakers along with possible mounting brackets array configuration data. The basic array information may include cabinet type 314 (loudspeaker model) aiming angle (angle with respect to the venue geometry) and splay angle 312 (angle between one or more loudspeakers). The use of multiple drivers for a set of speakers (within one or more loudspeakers) and amplifier channels provides the ability to beamform a wide range of vertical patterns from varying cabinet configurations. Varying the phase and/or amplitude of the driver pairs with linear phase finite impulse response (FIR) filters, the vertical patterns are created. Most vertical coverage angles desired are between 20 and 100 degrees with the majority of designs being closer to 40 degrees.

Figure 3B:
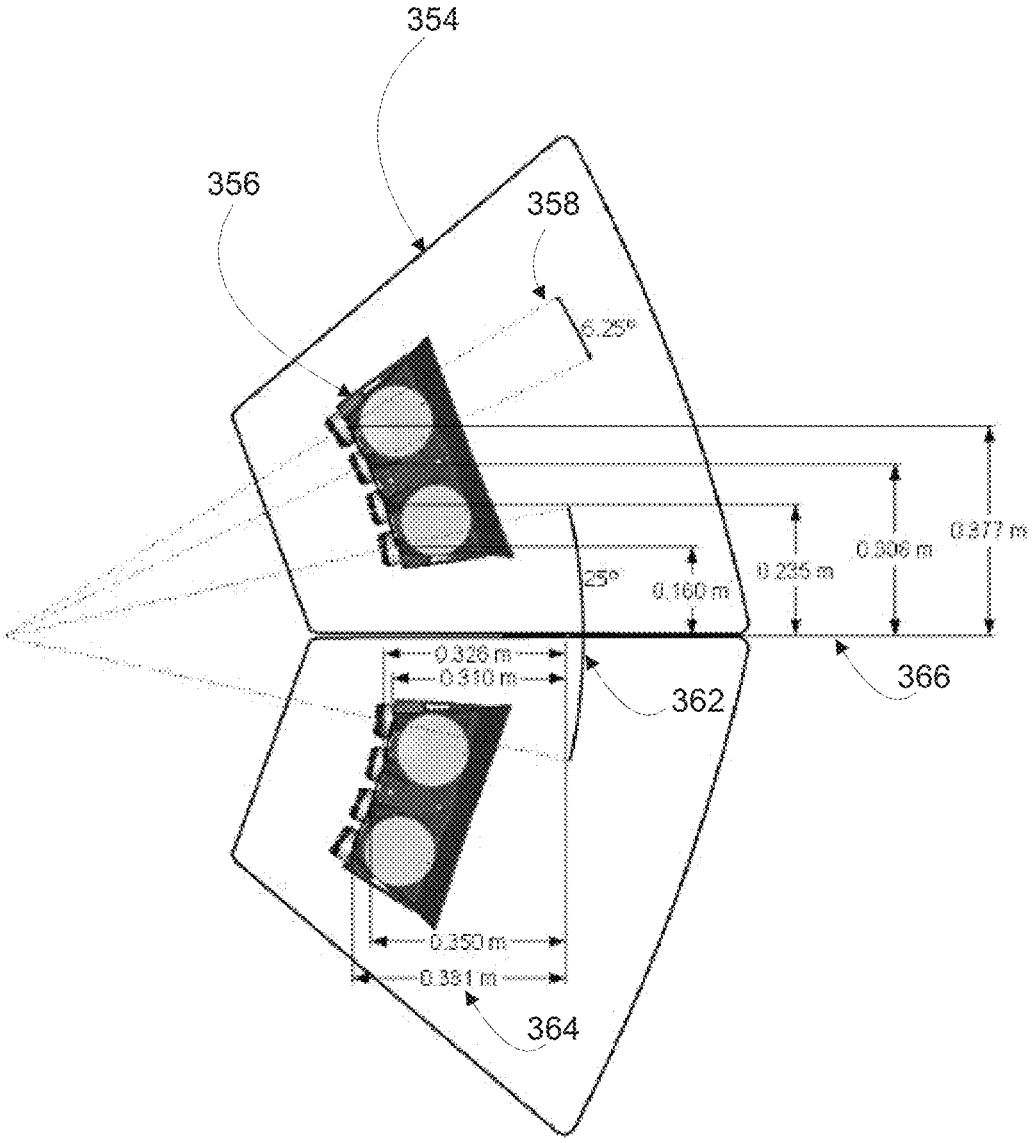
FIG. 3B illustrates a detailed loudspeaker array model with position specifications and aiming angles according to example embodiments.

FIG. 3B illustrates a detailed loudspeaker array model with position specifications and aiming angles according to example embodiments. Referring to FIG. 3B, the dual-cabinet configuration 350 includes cabinets 354 with driver placement 356 according to specific driver placement angles 358. The y-axis positions 366 are illustrated along with a certain aiming angle 362. The x-axis positions 364 are also illustrated for accurate driver placement. The angles between the cabinets are splay angles. The placement position of the drivers is the basis for calculating the spacing of the drivers.

Figure 4:
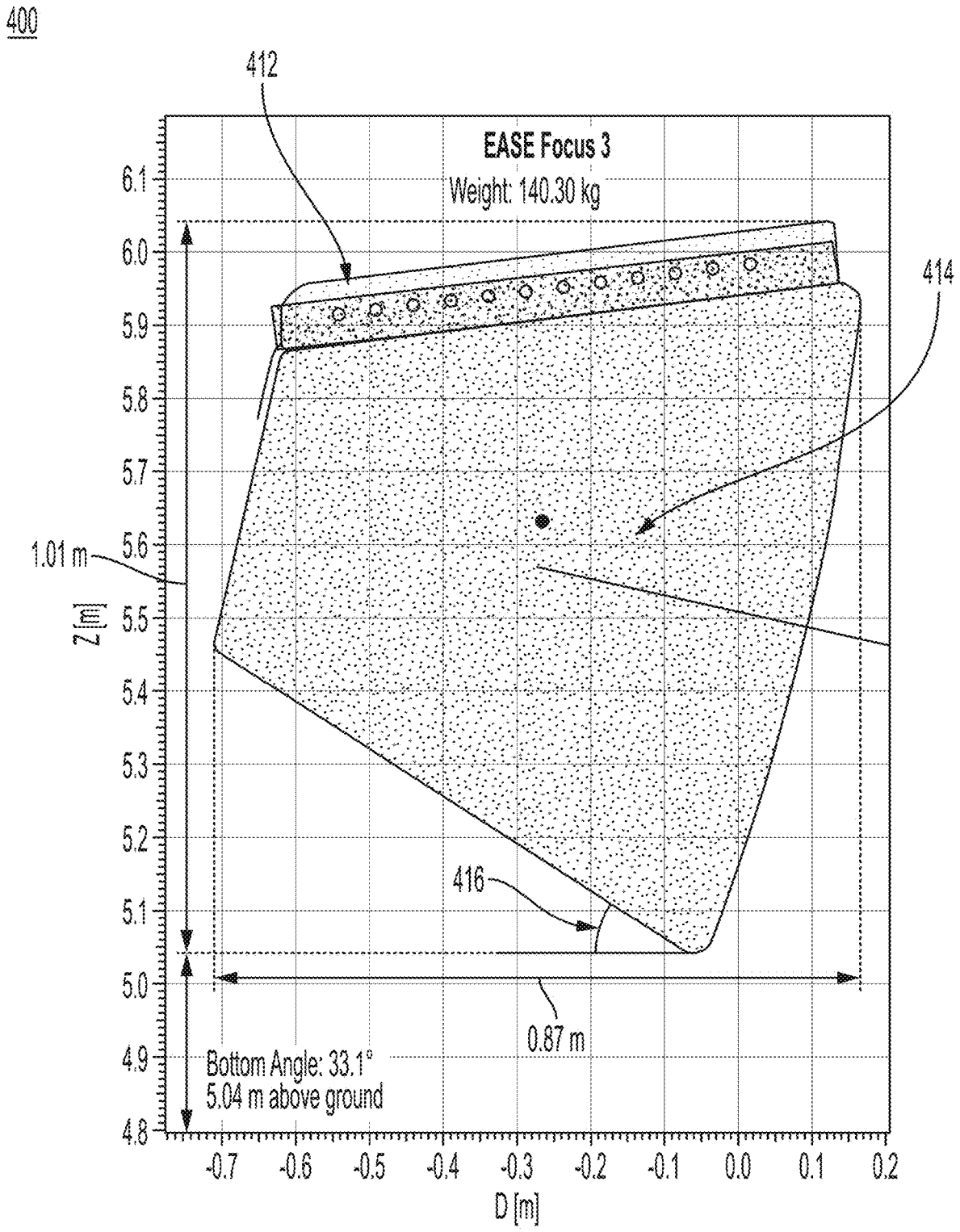
FIG. 4 illustrates an example graphical user interface of a single loudspeaker model according to example embodiments.

FIG. 4 illustrates an example graphical user interface of a single loudspeaker model according to example embodiments. Referring to FIG. 4, the example illustration includes a detailed schematic 400 of a loudspeaker cabinet 414 being configured with a mounting bracket 412 at a particular splay angle 416. The values may be varied to accommodate different polar spectrum goals.

Figure 5A:
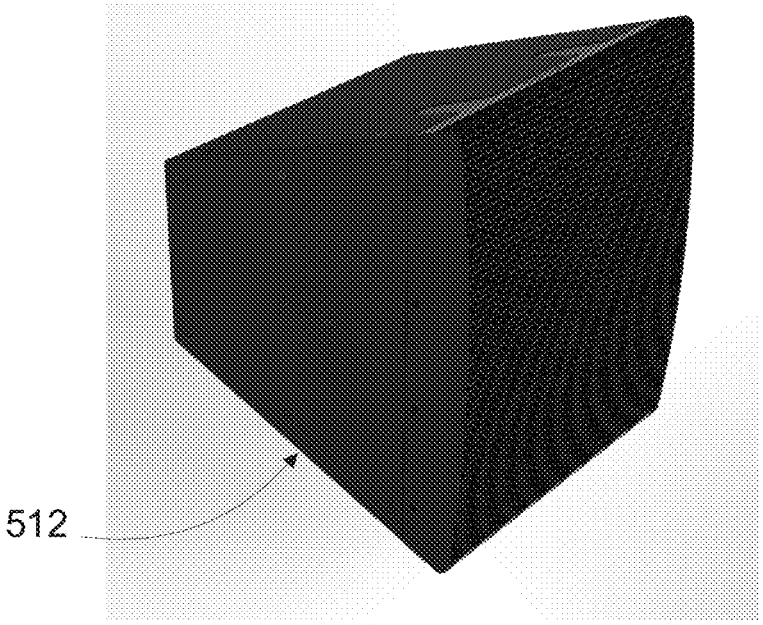
FIG. 5A illustrates an example loudspeaker housing according to example embodiments.

FIG. 5A illustrates an example loudspeaker housing according to example embodiments. Referring to FIG. 5A, the loudspeaker cabinet 512 is illustrated as one complete box which can be mounted on a wall or ceiling.

Figure 5B:
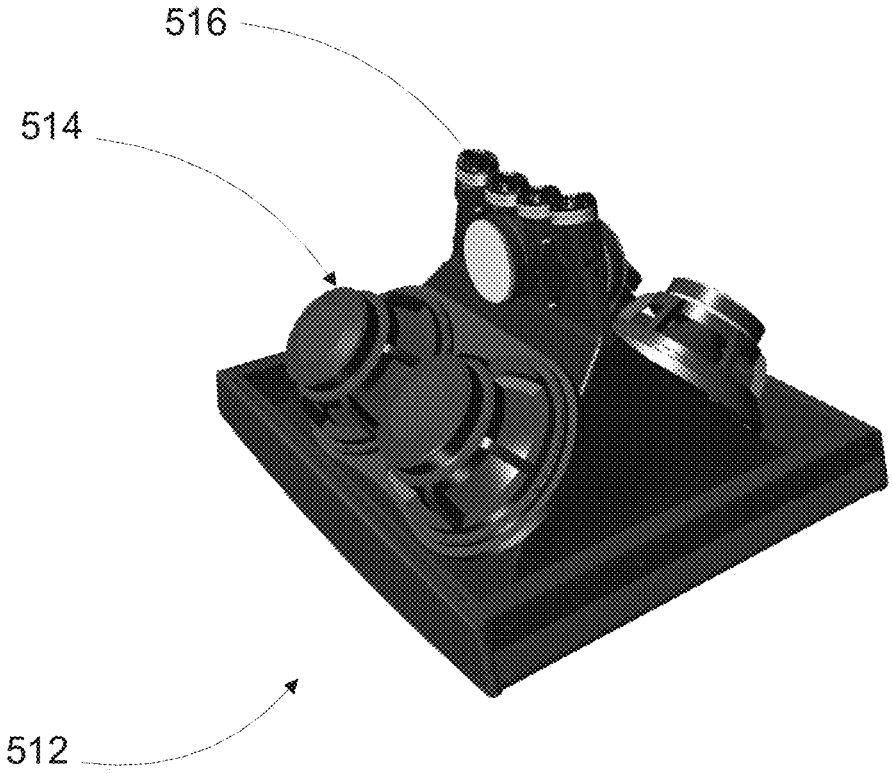
FIG. 5B illustrates an example loudspeaker housing internal view according to example embodiments.

FIG. 5B illustrates an example loudspeaker housing internal view according to example embodiments. Referring to FIG. 5B, the multi-driver loudspeaker 512 is illustrated as having various drivers including low frequency, high frequency and mid-frequency 514/516. By applying a finite impulse response (FIR) filter to each driver or group of drivers inside the loudspeaker cabinet, loudspeaker polar pattern can be optimized to best achieve the design objectives.

Figure 6:
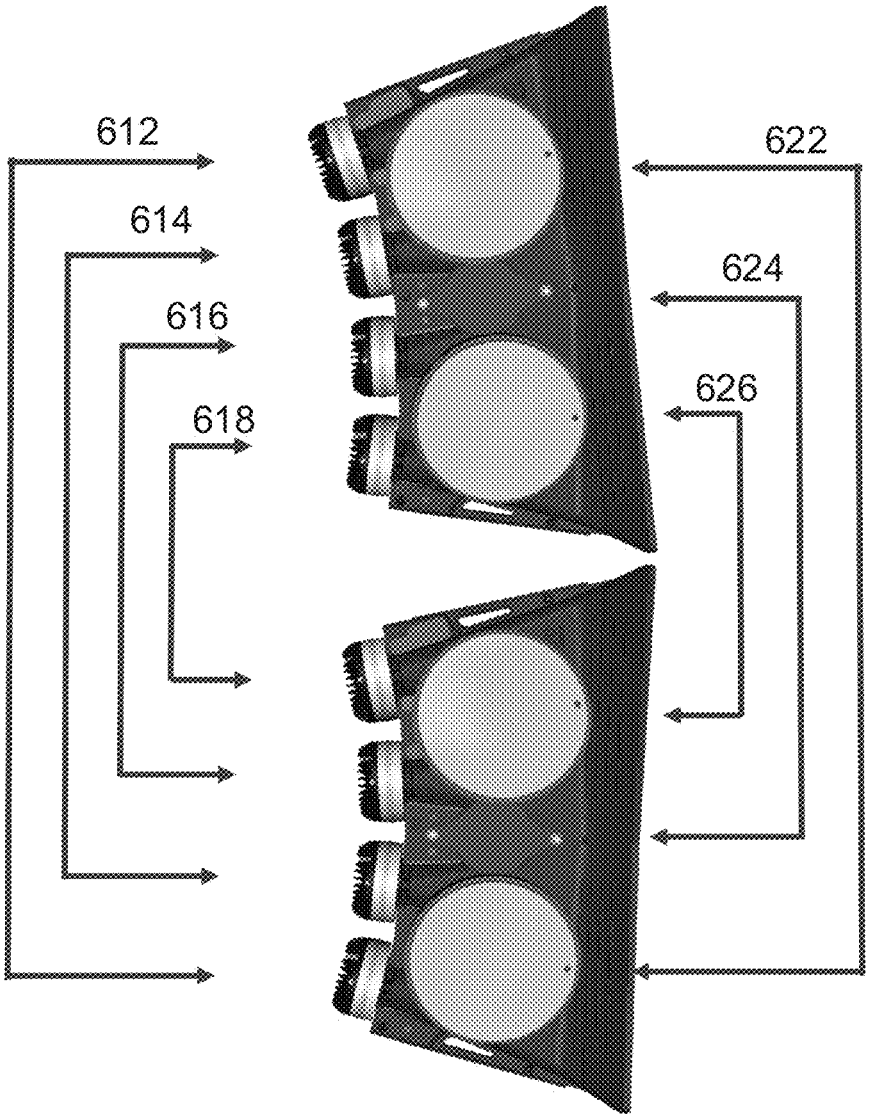
FIG. 6 illustrates a multi-driver loudspeaker pairing configuration according to example embodiments.

FIG. 6 illustrates a multi-driver loudspeaker pairing configuration according to example embodiments. Referring to FIG. 6, the drivers are organized in pairs 612-626 to drive the various speakers in one or more loudspeakers cabinets. Each loudspeaker can be customized to achieve a target vertical polar pattern as identified by a particular coverage angle. The simulations performed may produce various polar patterns which can be stored in a database and compared to an ideal pattern for a final selection. The selection will yield FIR filter values to apply to the loudspeaker configuration to yield the optimal result.

In one example, the coverage angle identified quantifies the polar pattern. The coverage angle is defined as the angular spread from on-axis (0 dB) to the −6 dB point on each side. A selected nominal value will indicate where most of the sound energy goes. In one example polar plot, the angular spread from on-axis (0 dB) to the −6 dB point is 30° on each side, so its coverage angle is 60°. The polar pattern is frequency dependent, different frequency bands applied to the same device will yield different polar patterns. Instead of viewing the polar plots of each frequency band, the coverage map can be used to view the broadband view of the polar plot. A polar plot would ideally demonstrate a coverage map that follows 6 dB on each side of a relative x-axis. Any area of the map which exceed or undershoot the ideal territory of the plot are either too wide or too narrow. No signal is expected to have its frequency range be exactly contiguous to the ideal angle range (i.e., 40, 50, 60 degrees, etc.).

The polar pattern of a multi-driver loudspeaker, according to example embodiments, can be manipulated by applying FIR filter(s) to each driver group. The magnitude and phase response of the FIR filter are selected for each frequency band and driver group. A driver group includes drivers which receive the same audio signal. If desired, each driver can form its own group. In one loudspeaker configuration, a symmetrical polar pattern may be desired and therefore, drivers that have top-bottom symmetry are grouped together. The example in FIG. 6 has 7 driver groups for a dual loudspeaker array. A single loudspeaker may only have 3 driver groups, in another example configuration.

Figure 7A:
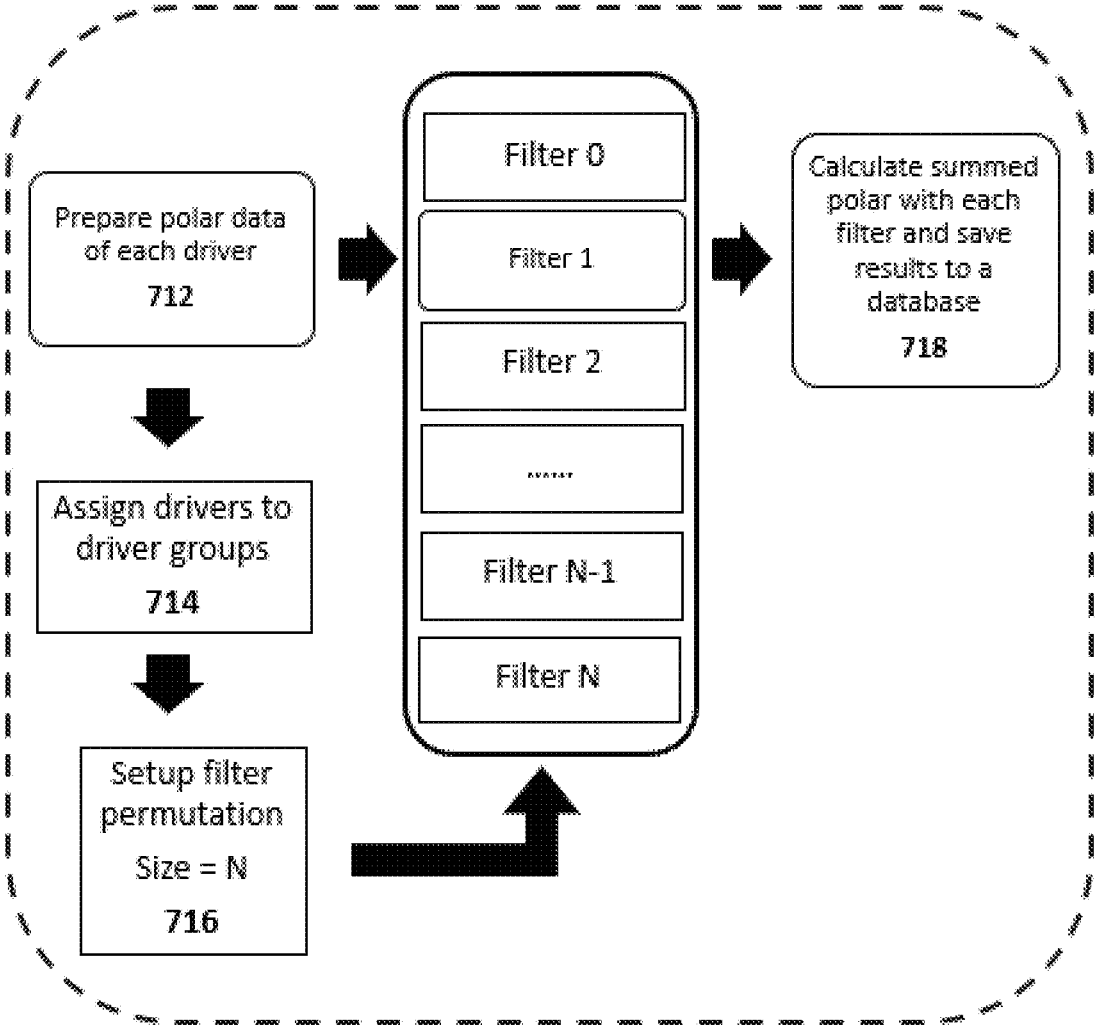
FIG. 7A illustrates a first part of a polar pattern loudspeaker creation procedure according to example embodiments.

FIG. 7A illustrates a first part of a polar pattern loudspeaker creation procedure according to example embodiments. Referring to FIG. 7A, in this example, the polar pattern database is populated by preparing polar data for each driver 712, assigning drivers 714 to one or more groups (i.e., driver pairs, etc.), establishing a filter permutation size "N" 716 as a number of permutations to perform with a corresponding number of filters. The result is a summation of polar patterns for each filter and the results are stored in a database 718.

Figure 7B:
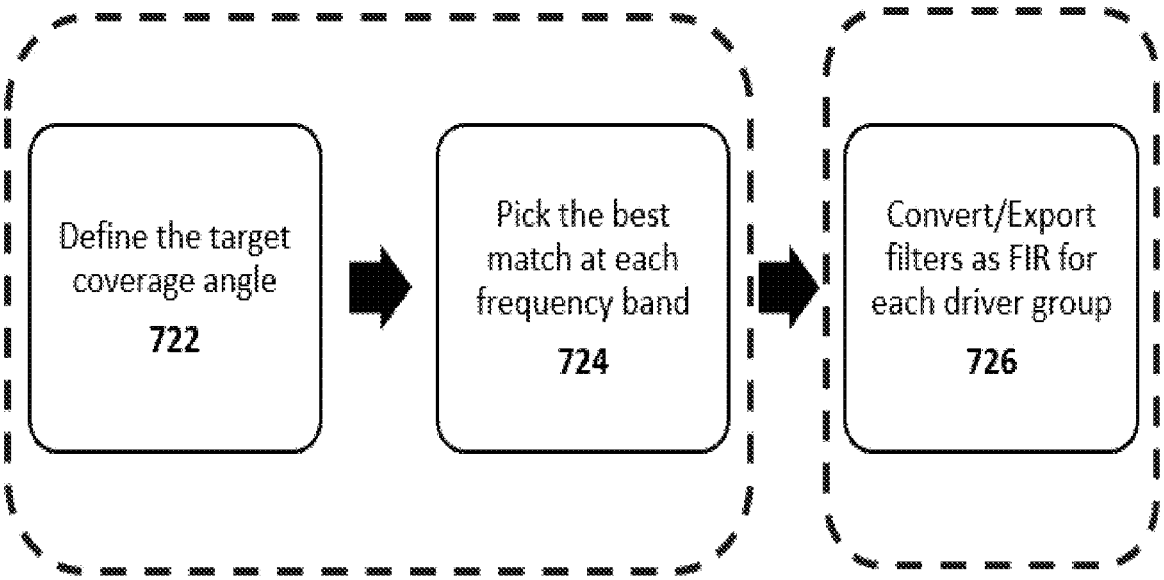
FIG. 7B illustrates a second part of a polar pattern loudspeaker creation procedure according to example embodiments.

FIG. 7B illustrates a second part of a polar pattern loudspeaker creation procedure according to example embodiments. Referring to FIG. 7B, the process continues with defining a target coverage angle 722 and selecting a best match at each frequency band 724 that is most ideal to the design angle goal (30, 40, 50, 60 degrees, etc.). The results in the database are searched for the polar patterns and the filters are converted to a FIR filter for each driver group 726.

Figure 8:
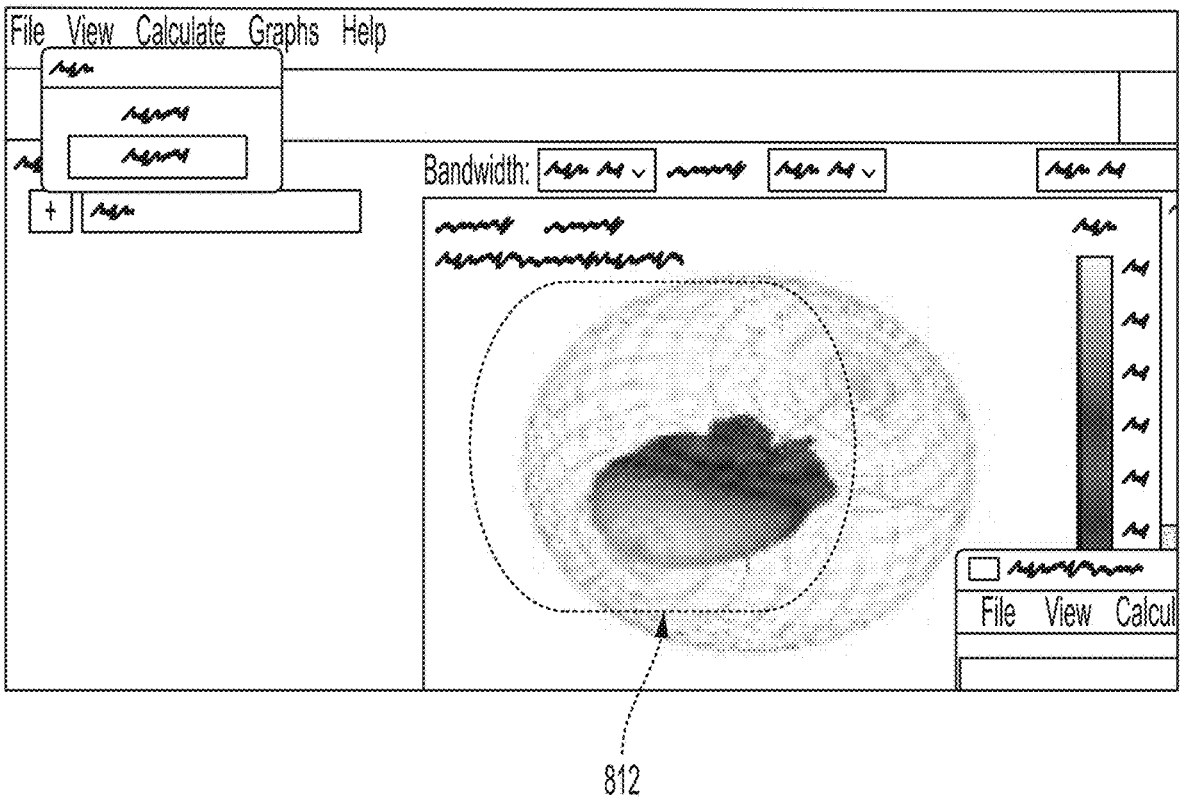
FIG. 8 illustrates a first example model of a polar audio speaker pattern user interface according to example embodiments.

FIG. 8 illustrates a first example model of loudspeaker polar pattern user interface according to example embodiments. Referring to FIG. 8, the polar pattern example interface 800 includes a polar pattern model 812 as being substantially narrow with little volume.

Figure 9:
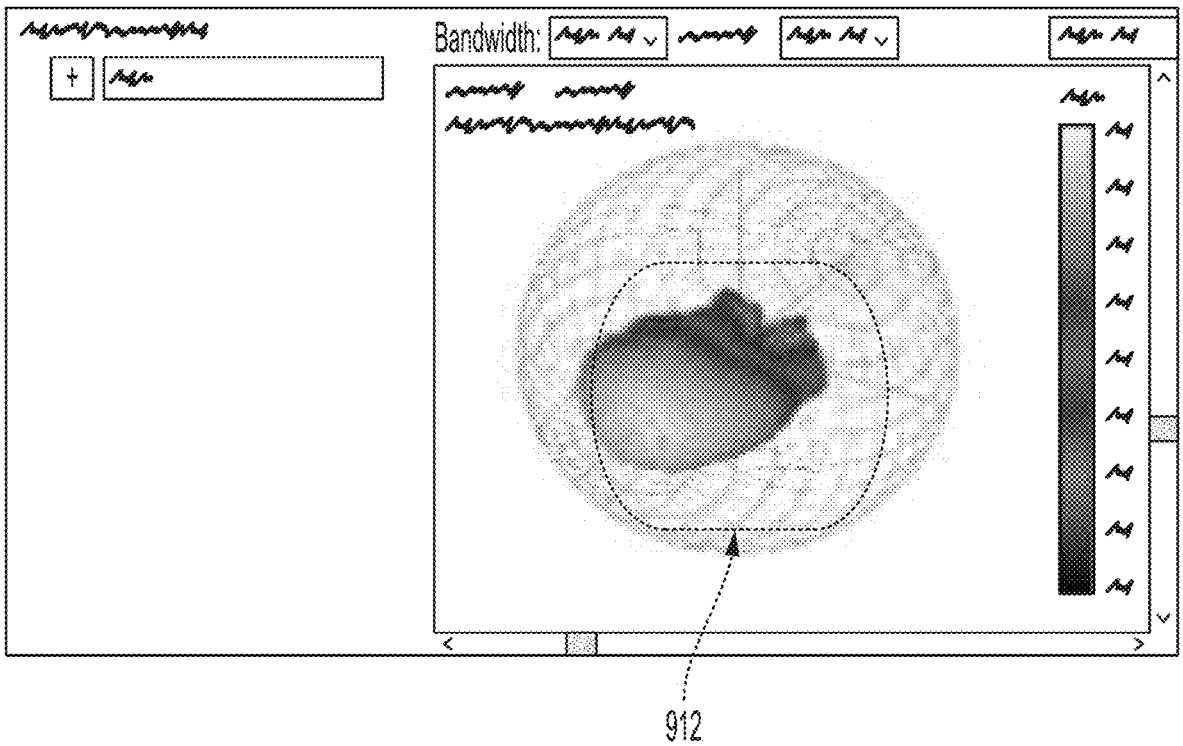
FIG. 9 illustrates a second example model of a polar audio speaker pattern user interface according to example embodiments.

FIG. 9 illustrates a second example model of a loudspeaker polar pattern user interface according to example embodiments. Referring to FIG. 9, the polar pattern example interface 900 includes a polar pattern model 912 as being less narrow than the example in FIG. 8 with limited volume.

Figure 10:
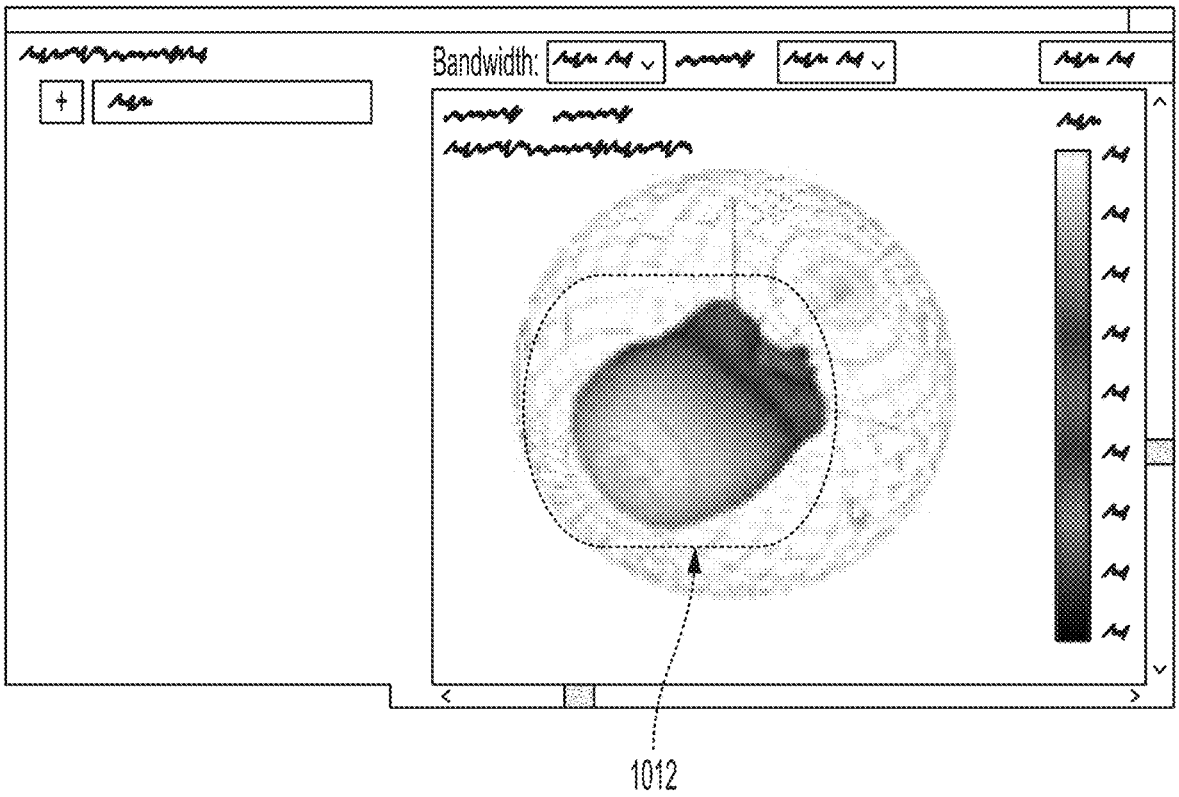
FIG. 10 illustrates a third example model of a polar audio speaker pattern user interface according to example embodiments.

FIG. 10 illustrates a third example model of a loudspeaker polar pattern user interface according to example embodiments. Referring to FIG. 10, the polar pattern example interface 1000 includes a polar pattern model 1012 as being substantially round as compared to the examples in FIGS. 8 and 9.

The process of identifying a best polar pattern and applying the pattern attributes to a loudspeaker array may include establishing a filter permutation based on the number of groups, magnitude adjustment range/step, and phase adjustment range/step (permutation size=N). Calculate the summed polar with each filter and save the result to the database and repeat 'N' times. Each summed polar includes the complex summation of all drivers' transfer function at each angular position. The calculation counts for each driver's position, orientation, and filter setting. Calculation speed depends on driver quantity, angular resolution, frequency resolution, and the CPU used. The file size of each polar depends on the angular resolution and frequency resolution. In one example, 350 KB of data per polar (1° parallel resolution, 180° meridian resolution, 1/24 oct. bandwidth). In a coarse setup magnitude range of −6 to 0 dB, magnitude step of 3 dB and a phase range of −90 to 0 degrees and a phase step of 15 degrees, a one group would yield $N=(6/3+1)\times(90/15+1)=21$, and thus $N=21$. As the number of groups grows the permutation size will grow raised to the power of the number of groups N to the power of (number of groups). The value of N will increase as the magnitude or phase range is increased and as the magnitude or phase step is decreased, such actions are a natural part of the finer setup parameters.

Another strategy is to perform an acoustic redundancy removal technique (ARRT). In this process, before a polar calculation is performed, the entire permutation may be examined to identify any acoustically redundant permutations and remove them prior to performing the calculation. When there are an increasing number of driver groups, this may reduce the total number of permutations by over 50 percent and thus processing is greatly reduced. Another strategy is to perform a polar identifier extraction technique (PIET) which extracts certain key information to identify and reproduce a polar pattern without adding additional data. The overall storage size is reduced.

When searching the polar database of stored polar patterns from the permutations, the target coverage area (degrees) is used as a basis for the application to select those polar patterns which are closest to that range in an order of a closest match and repeat for each frequency range. Other criteria can be used to limit the choices. For example, lobes outside the coverage area can be identified as polar patterns which are not ideal. Thresholds can be used to limit the amount of lobe coverage area outside the specified coverage area.

FIG. 11A illustrates a graphed model of a loudspeaker polar pattern displayed in a user interface according to example embodiments. Referring to FIG. 11A, the table 1100 provides a set of values associated with a particular polar pattern entry in the database. The entries in this example are sorted by relevancy or closeness to the objective parameters. As may be observed, the lobes are also part of the comparison process. The set of results all have 20 degree angle output polar patterns, however, the other parameters are part of the process of selection since the last ranked entry 1114 has a large lobe size. The first entry 1112 has the smallest lobe size and the highest energy intensity within the coverage angle '47'. Once the polar pattern is selected at each frequency band, automatically or manually, the filters are converted to a FIR filter for each driver group and those filters are applied to the loudspeaker for an outputted audio signal.

Figure 11B:
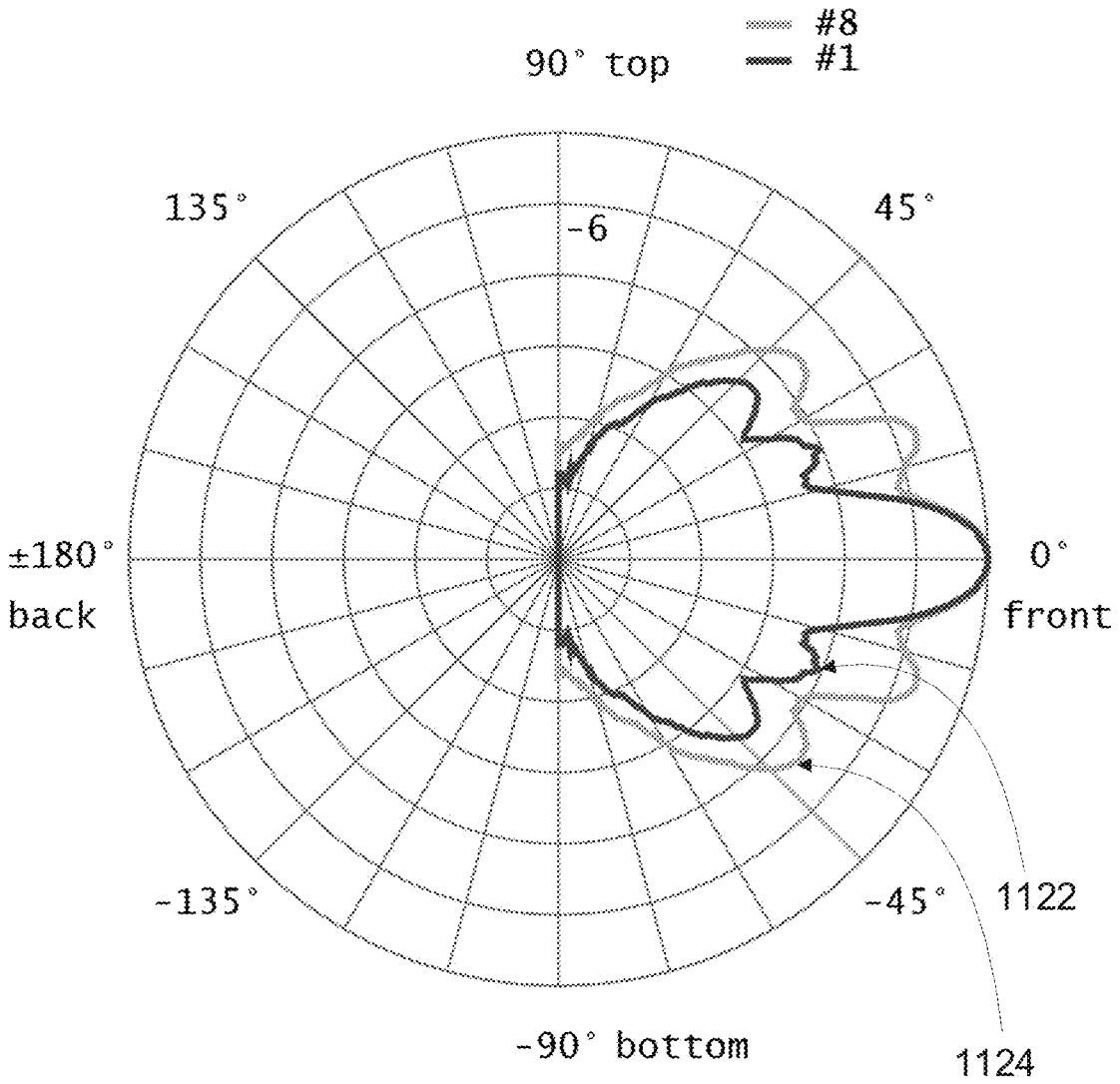
FIG. 11B illustrates a graphed model of polar audio speaker patterns displayed in a user interface according to example embodiments.

FIG. 11B illustrates a graphed model of polar audio speaker patterns 1150 displayed in a user interface according to example embodiments. Referring to FIG. 11B, the # 1 selection 1112 from the table 1100 is illustrated 1122 as the darker line with smaller side lobes outside the coverage area (i.e., 20 degrees). The worst polar pattern 1114 is also illustrated 1124 to demonstrate the difference in size between the two patterns.

Figure 12:
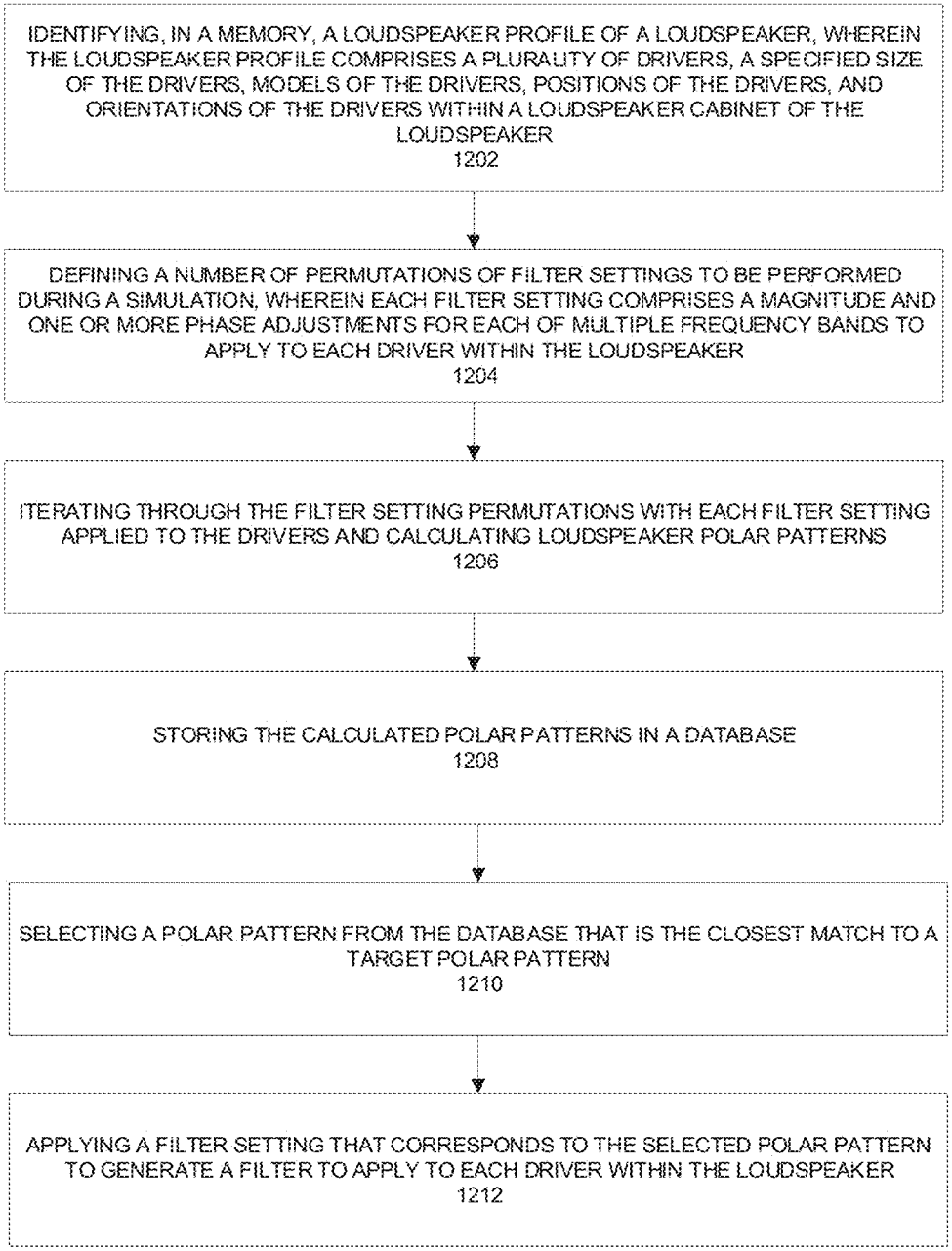
FIG. 12 illustrates an example process according to example embodiments.

FIG. 12 illustrates an example process according to example embodiments. Referring to FIG. 12, the process 1200 may include identifying 1202, in a memory, a loudspeaker profile of a loudspeaker, and the loudspeaker profile includes a plurality of drivers, a specified size of the drivers, models of the drivers, positions of the drivers, and orientations of the drivers within a loudspeaker cabinet of the loudspeaker, defining a number of permutations of filter settings to be performed during a simulation, wherein each filter setting comprises a magnitude and one or more phase adjustments for each of multiple frequency bands to apply to each driver within the loudspeaker 1204, iterating through the filter setting permutations with each filter setting applied to the drivers and calculating loudspeaker polar patterns 1206, storing the calculated polar patterns in a database 1208, selecting a polar pattern from the database that is the closest match to a target polar pattern 1210, and applying a filter setting that corresponds to the selected polar pattern to generate a filter to apply to each driver within the loudspeaker 1212.

The process may also include identifying the target polar pattern from a target coverage angle, defining polar pattern rating criteria which are dependent on the target polar pattern, and calculating a rating of each polar pattern using the rating criteria, and wherein each driver is assigned one or more unique filters. A size of the filter setting permutations is dependent on a specified magnitude adjustment range and step, phase adjustment range and step, and driver quantity, and each driver at each frequency band has one magnitude value and phase adjustment value for each filter setting. The values may include $M_r$=magnitude adjustment range (dB), $M_s$=magnitude step (dB), $P_r$=phase adjustment range (degree), $P_s$=phase step (degree), n=driver quantity, and filter setting permutation size $N=[(M_r/M_s+1)\times(P_r/P_s+1)]^n$. The process may also include performing an acoustic redundancy removal technique (ARRT), which identifies filter settings in the permutations that are acoustically redundant and removes them from the permutations to reduce the number of permutations required to be performed. The process may also include identifying the filter setting and rating criteria of the polar pattern to reproduce the polar patterns. The rating criteria may include a nominal coverage angle, a dissimilarity value with respect to the target polar pattern, a maximum lobe intensity outside of the coverage angle, a total lobe intensity outside of the coverage angle, a maximum lobe intensity within the coverage angle, an energy intensity within the coverage angle, and a maximum magnitude attenuation. The process may also include iterating through the polar pattern database and selecting the polar pattern with the highest similarity to the target polar pattern. The process may also include selecting an optimal match to the target polar pattern by a polar pattern sorting mode that applies one or more parameters from the rating criteria to sort the polar patterns and select the optimal match and the quantity of calculated polar patterns is equal to the filter setting permutations size.

The operations of a method or algorithm described in connection with the embodiments disclosed herein may be embodied directly in hardware, in a computer program executed by a processor, or in a combination of the two. A computer program may be embodied on a computer readable medium, such as a storage medium. For example, a computer program may reside in random access memory ("RAM"), flash memory, read-only memory ("ROM"), erasable programmable read-only memory ("EPROM"), electrically erasable programmable read-only memory ("EEPROM"), registers, hard disk, a removable disk, a compact disk read-only memory ("CD-ROM"), or any other form of storage medium known in the art.

Figure 13:
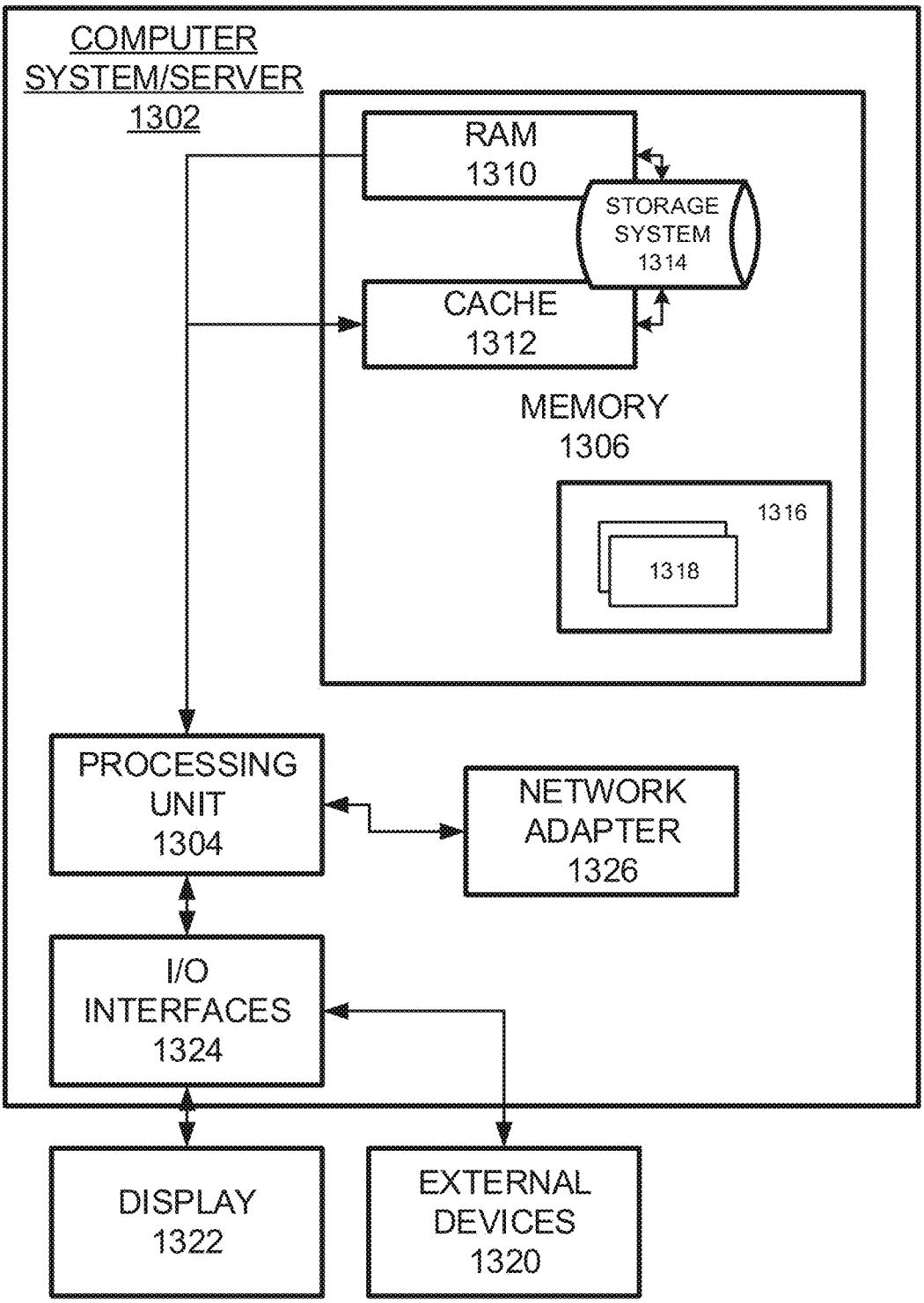
FIG. 13 illustrates a system configuration of a computer readable medium according to example embodiments.

FIG. 13 is not intended to suggest any limitation as to the scope of use or functionality of embodiments of the application described herein. Regardless, the computing node 1300 is capable of being implemented and/or performing any of the functionality set forth hereinabove.

In computing node 1300 there is a computer system/server 1302, which is operational with numerous other general purpose or special purpose computing system environments or configurations. Examples of well-known computing systems, environments, and/or configurations that may be suitable for use with computer system/server 1302 include, but are not limited to, personal computer systems, server computer systems, thin clients, rich clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 1302 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 1302 may be practiced in distributed cloud computing environments where tasks are performed by remote processing devices that are linked through a communications network. In a distributed cloud computing environment, program modules may be located in both local and remote computer system storage media including memory storage devices.

As displayed in FIG. 13, computer system/server 1302 in cloud computing node 1300 is displayed in the form of a general-purpose computing device. The components of computer system/server 1302 may include, but are not limited to, one or more processors or processing units 1304, a system memory 1306, and a bus that couples various system components including system memory 1306 to processor 1304.

The bus represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 1302 typically includes a variety of computer system readable media. Such media may be any available media that is accessible by computer system/server 1302, and it includes both volatile and non-volatile media, removable and non-removable media. System memory 1306, in one embodiment, implements the flow diagrams of the other figures. The system memory 1306 can include computer system readable media in the form of volatile memory, such as random-access memory (RAM) 1310 and/or cache memory 1312. Computer system/server 1302 may further include other removable/non-removable, volatile/non-volatile computer system storage media. By way of example only, storage system 1314 can be provided for reading from and writing to a non-removable, non-volatile magnetic media (not displayed and typically called a "hard drive"). Although not displayed, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to the bus by one or more data media interfaces. As will be further depicted and described below, memory 1306 may include at least one program product having a set (e.g., at least one) of program modules that are configured to carry out the functions of various embodiments of the application.

Program/utility 1316, having a set (at least one) of program modules 1318, may be stored in memory 1306 by way of example, and not limitation, as well as an operating system, one or more application programs, other program modules, and program data. Each of the operating system, one or more application programs, other program modules, and program data or some combination thereof, may include an implementation of a networking environment. Program modules 1318 generally carry out the functions and/or methodologies of various embodiments of the application as described herein.

As will be appreciated by one skilled in the art, aspects of the present application may be embodied as a system, method, or computer program product. Accordingly, aspects of the present application may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present application may take the form of a computer program product embodied in one or more computer readable medium(s) having computer readable program code embodied thereon.

Computer system/server 1302 may also communicate with one or more external devices 1320 such as a keyboard, a pointing device, a display 1322, etc.; one or more devices that enable a user to interact with computer system/server 1302; and/or any devices (e.g., network card, modem, etc.) that enable computer system/server 1302 to communicate with one or more other computing devices. Such communication can occur via I/O interfaces 1324. Still yet, computer system/server 1302 can communicate with one or more networks such as a local area network (LAN), a general wide area network (WAN), and/or a public network (e.g., the Internet) via network adapter 1326. As depicted, network adapter 1326 communicates with the other components of computer system/server 1302 via a bus. It should be understood that although not displayed, other hardware and/or software components could be used in conjunction with computer system/server 1302. Examples include, but are not limited to: microcode, device drivers, redundant processing units, external disk drive arrays, RAID systems, tape drives, and data archival storage systems, etc.

One skilled in the art will appreciate that a "system" could be embodied as a personal computer, a server, a console, a personal digital assistant (PDA), a cell phone, a tablet computing device, a smartphone or any other suitable computing device, or combination of devices. Presenting the above-described functions as being performed by a "system" is not intended to limit the scope of the present application in any way but is intended to provide one example of many embodiments. Indeed, methods, systems and apparatuses disclosed herein may be implemented in localized and distributed forms consistent with computing technology.

It should be noted that some of the system features described in this specification have been presented as modules, in order to more particularly emphasize their implementation independence. For example, a module may be implemented as a hardware circuit comprising custom very large-scale integration (VLSI) circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together but may comprise disparate instructions stored in different locations which, when joined logically together, comprise the module and achieve the stated purpose for the module. Further, modules may be stored on a computer-readable medium, which may be, for instance, a hard disk drive, flash device, random access memory (RAM), tape, or any other such medium used to store data.

Indeed, a module of executable code could be a single instruction, or many instructions, and may even be distributed over several different code segments, among different programs, and across several memory devices. Similarly, operational data may be identified and illustrated herein within modules and may be embodied in any suitable form and organized within any suitable type of data structure. The operational data may be collected as a single data set or may be distributed over different locations including over different storage devices, and may exist, at least partially, merely as electronic signals on a system or network.

It will be readily understood that the components of the application, as generally described and illustrated in the figures herein, may be arranged and designed in a wide variety of different configurations. Thus, the detailed description of the embodiments is not intended to limit the scope of the application as claimed but is merely representative of selected embodiments of the application.

One having ordinary skill in the art will readily understand that the above may be practiced with steps in a different order, and/or with hardware elements in configurations that are different than those which are disclosed. Therefore, although the application has been described based upon these preferred embodiments, it would be apparent to those of skill in the art that certain modifications, variations, and alternative constructions would be apparent.

While preferred embodiments of the present application have been described, it is to be understood that the embodiments described are illustrative only and the scope of the application is to be defined solely by the appended claims when considered with a full range of equivalents and modifications (e.g., protocols, hardware devices, software platforms etc.) thereto.

What is claimed is:

1. A method, comprising:

identifying, in a memory, a loudspeaker profile of a loudspeaker, wherein the loudspeaker profile comprises a plurality of drivers, a specified size of the drivers, models of the drivers, positions of the drivers, and orientations of the drivers within a loudspeaker cabinet of the loudspeaker;

defining a number of permutations of filter settings to be performed during a simulation, wherein each filter setting comprises one or more of a magnitude and phase adjustment for each of multiple frequency bands to apply to each driver within the loudspeaker;

iterating through the filter setting permutations with each filter setting applied to the drivers and calculating loudspeaker polar patterns;

storing the calculated polar patterns in a database;

selecting a polar pattern from the database that is the closest match to a target polar pattern; and applying a filter setting that corresponds to the selected polar pattern to generate a FIR to apply to each driver within the loudspeaker.

2. The method of claim 1, comprising identifying the target polar pattern from a target coverage angle;

defining polar pattern rating criteria which are dependent on the target polar pattern; and calculating a rating of each polar pattern using the rating criteria, and wherein each driver is assigned one or more unique filters.

3. The method of claim 1, wherein a size of the filter setting permutations is dependent on a specified magnitude adjustment range and step, phase adjustment range and step, and driver quantity, and wherein each driver at each frequency band has one magnitude value and phase adjustment value for each filter setting.

4. The method of claim 3, wherein:

$M_r$=magnitude adjustment range (dB);

$M_s$=magnitude step (dB);

$P_r$=phase adjustment range (degree);

$P_s$=phase step (degree);

n=driver quantity; and filter setting permutation size $N=[(M_r/M_s+1)\times(P_r/P_s+1)]^n$.

5. The method of claim 2, comprising:

performing an acoustic redundancy removal technique (ARRT), which identifies filter settings in the permutations that are acoustically redundant and removes them from the permutations to reduce the number of permutations required to be performed.

6. The method of claim 5, comprising:

identifying the filter setting and rating criteria of the polar pattern to reproduce the polar patterns.

7. The method of claim 2, wherein the rating criteria comprise:

a nominal coverage angle;

a dissimilarity value with respect to the target polar pattern;

a maximum lobe intensity outside of the coverage angle;

a total lobe intensity outside of the coverage angle;

a maximum lobe intensity within the coverage angle;

an energy intensity within the coverage angle; and a maximum magnitude attenuation.

8. The method of claim 1, comprising:

iterating through the polar pattern database and selecting the polar pattern with the highest similarity to the target polar pattern.

9. The method of claim 2, comprising:

selecting an optimal match to the target polar pattern by a polar pattern sorting mode that applies one or more parameters from the rating criteria to sort the polar patterns and select the optimal match.

10. The method of claim 1, wherein the quantity of calculated polar patterns is equal to the filter setting permutations size.

11. An apparatus, comprising:

a processor configured to identify, in a memory, a loudspeaker profile of a loudspeaker, wherein the loudspeaker profile comprises a plurality of drivers, a specified size of the drivers, models of the drivers, positions of the drivers, and orientations of the drivers within a loudspeaker cabinet of the loudspeaker;

define a number of permutations of filter settings to be performed during a simulation, wherein each filter setting comprises one or more of a magnitude and phase adjustment for each of multiple frequency bands to apply to each driver within the loudspeaker;

iterate through the filter setting permutations with each filter setting applied to the drivers and calculating loudspeaker polar patterns;

store the calculated polar patterns in a database;

select a polar pattern from the database that is the closest match to a target polar pattern; and apply a filter setting that corresponds to the selected polar pattern to generate a FIR to apply to each driver within the loudspeaker.

12. The apparatus of claim 11, wherein the processor is further configured to perform:

identifying the target polar pattern from a target coverage angle;

defining polar pattern rating criteria which are dependent on the target polar pattern; and calculating a rating of each polar pattern using the rating criteria, and wherein each driver is assigned one or more unique filters.

13. The apparatus of claim 11, wherein a size of the filter setting permutations is dependent on a specified magnitude adjustment range and step, phase adjustment range and step, and driver quantity, and wherein each driver at each frequency band has one magnitude value and phase adjustment value for each filter setting.

14. The apparatus of claim 13, wherein:

$M_r$=magnitude adjustment range (dB);

$M_s$=magnitude step (dB);

$P_r$=phase adjustment range (degree);

$P_s$=phase step (degree);

n=driver quantity; and filter setting permutation size $N=[(M_r/M_s+1)\times(P_r/P_s+1)]^n$.

15. The apparatus of claim 12, wherein the processor is further configured to perform:

performing an acoustic redundancy removal technique (ARRT), which identifies filter settings in the permutations that are acoustically redundant and removes them from the permutations to reduce the number of permutations required to be performed.

16. The apparatus of claim 15, wherein the processor is further configured to perform:

identifying the filter setting and rating criteria of the polar pattern to reproduce the polar patterns.

17. The apparatus of claim 12, wherein the rating criteria comprise:

a nominal coverage angle;

a dissimilarity value with respect to the target polar pattern;

a maximum lobe intensity outside of the coverage angle;

a total lobe intensity outside of the coverage angle;

a maximum lobe intensity within the coverage angle;

an energy intensity within the coverage angle; and a maximum magnitude attenuation.

18. The apparatus of claim 11, wherein the processor is further configured to perform:

iterating through the polar pattern database and selecting the polar pattern with the highest similarity to the target polar pattern.

19. The apparatus of claim 12, wherein the processor is further configured to perform:

selecting an optimal match to the target polar pattern by a polar pattern sorting mode that applies one or more parameters from the rating criteria to sort the polar patterns and select the optimal match.

20. A non-transitory computer readable storage medium configured to store instructions that when executed cause a processor to perform:

identifying, in a memory, a loudspeaker profile of a loudspeaker, wherein the loudspeaker profile comprises a plurality of drivers, a specified size of the drivers, models of the drivers, positions of the drivers, and orientations of the drivers within a loudspeaker cabinet of the loudspeaker;

defining a number of permutations of filter settings to be performed during a simulation, wherein each filter setting comprises one or more of a magnitude and phase adjustment for each of multiple frequency bands to apply to each driver within the loudspeaker;

iterating through the filter setting permutations with each filter setting applied to the drivers and calculating loudspeaker polar patterns;

storing the calculated polar patterns in a database;

selecting a polar pattern from the database that is the closest match to a target polar pattern; and applying a filter setting that corresponds to the selected polar pattern to generate a FIR to apply to each driver within the loudspeaker.

* * * * *